United States Patent [19]

Hinzmann

[11] 4,262,680

[45] Apr. 21, 1981

[54] METHOD AND APPARATUS FOR ATTACHING FILTER PLUGS TO CIGARETTES OR THE LIKE

[75] Inventor: Alfred Hinzmann, Richmond, Va.

[73] Assignee: Hauni-Werke Körber & Co. Kg., Hamburg, Fed. Rep. of Germany

[21] Appl. No.: 72,158

[22] Filed: Sep. 5, 1979

[51] Int. Cl.[3] ..... A24C 5/50

[52] U.S. Cl. ..... 131/94

[58] Field of Search ..... 131/61, 29, 30, 58, 131/59, 60, 61 A, 61 B, 67, 68, 71, 72, 76, 88, 90, 92, 93–95; 93/1 C, 77 FT; 156/583.1, 583.4

[56] References Cited

U.S. PATENT DOCUMENTS

| | | | |
|---|---|---|---|
| 3,420,243 | 1/1969 | McArthur | 131/94 |
| 4,149,546 | 4/1979 | Luke et al. | 131/94 |

*Primary Examiner*—Stephen C. Pellegrino
*Attorney, Agent, or Firm*—Peter K. Kontler

[57] ABSTRACT

Uncoated filter plugs of double unit length which are about to be attached to pairs of plain cigarettes of unit length in a filter tipping machine are treated by a narrow heated smooth surface of a stationary smoothing device which is adjacent to the path of sidewise movement of successive filter plugs and contacts successive increments of a narrow strip-shaped portion of the peripheral surface of each of a series of filter plugs while the filter plugs move sideways with the respective pairs of plain cigarettes. The heated surface is in frictional engagement with and bears against the peripheral surfaces of adjacent filter plugs to smoothen the strip-shaped portions of such peripheral surfaces. The smoothed strip-shaped portions are thereupon contacted by marginal portions of adhesive-coated uniting bands which are convoluted around the respective filter plugs and around the adjacent inner end portions of the respective plain cigarettes to form therewith filter cigarettes of double unit length. Smoothing of strip-shaped portions insures reliable adherence of marginal portions of uniting bands thereto.

19 Claims, 5 Drawing Figures

METHOD AND APPARATUS FOR ATTACHING FILTER PLUGS TO CIGARETTES OR THE LIKE

BACKGROUND OF THE INVENTION

The present invention relates to a method and apparatus for attaching filter plugs (e.g., filter plugs of double unit length) to rod-shaped tobacco-containing articles such as plain cigarettes, cigars or cigarillos. More particularly, the invention relates to improvements in treatment or processing of the filter plugs, especially of so-called NWA filters, prior to their attachment to plain cigarettes or the like.

It is well known to produce filter cigarettes in a so-called filter tipping machine (e.g., a machine known as MAX S, produced by the assignee of the present application) wherein pairs of plain cigarettes are connected to filter plugs of double unit length by adhesive-coated uniting bands which are convoluted about filter plugs and about the adjacent inner end portions of plain cigarettes. During convoluting, groups of three coaxial rod-shaped articles (including two spaced-apart plain cigarettes of unit length and a filter plug of double unit length therebetween) are caused to advance through a gap which is defined by two surfaces moving relative to each other and whose width is less than the diameters of articles in a group so that the groups are caused to roll about their respective axes and convert originally flat sheet-like uniting bands into tubes which sealingly connect the filter plugs to the respective pairs of plain cigarettes. The resulting filter cigarettes of double unit length are thereupon severed to yield pairs of filter cigarettes of unit length. Uniting bands are attached to successive groups during travel of such groups in the flutes of a transfer conveyor which delivers the groups (each of which carries a non-convoluted uniting band) to the components serving to roll the groups about their respective axes.

The uniting bands are obtained by severing the leader of a web of cigarette paper, artificial cork or like wrapping material at regular intervals subsequent to coating of one side of the web with a suitable adhesive. Such uniting bands normally establish fluidtight seals between the filter plugs and the adjacent plain cigarettes, especially if the filter plugs are of the type wherein a cylindrical section consisting of filter material (such as filamentary filter material and/or granular filter material) is surrounded by a tubular wrapper of cigarette paper or the like. The adhesive-coated sides of uniting bands readily adhere to the wrappers of filter plugs as well as to the wrappers (tubes consisting of cigarette paper) of plain cigarettes.

Problems arise when the filter plugs which are used in the manufacture of filter cigarettes, cigars or cigarillos do not have distinct wrappers, i.e., when the tobacco-containing rod-shaped articles are attached to so-called NWA filters. The unrwapped peripheral surfaces of NWA filters (hereinafter called unwrapped filters) are not smooth because such surfaces are formed by the rather coarse filamentary filter material, normally fibers consisting of synthetic thermoplastic material. Moreover, the peripheral surfaces of unwrapped filters are not as uniformly convex or round as the peripheral surfaces of wrappers on conventional filter plugs.

On the other hand, unwrapped filters or filter plugs are preferred in many presently popular brands of filter cigarettes or the like because they facilitate the manufacture of rod-shaped smokers' products with so-called ventilation or climatic zones, namely, filter cigarettes, cigars or cigarillos (hereinafter referred to as filter cigarettes) wherein the wrappers exhibit a certain degree of permeability to allow predetermined quantities of cool atmospheric air to penetrate through the wrappers and to mix with the columns of tobacco smoke. The permeability of unwrapped filter plugs (as considered in the radial direction thereof) is much more pronounced and more uniform than the permeability of wrappers of conventional filter plugs. Furthermore, ventilation or climatic zones can be estalished by the simple expedient of utilizing uniting bands whose material exhibits a predetermined porosity. Such porosity determines the so-called degree of ventilation of finished filter cigarettes.

Since the peripheral surfaces of unwrapped filter plugs are rough (i.e., rougher than the peripheral surfaces of wrappers forming part of conventional filter plugs), the adhesive-coated uniting bands are much less likely to adhere to the peripheral surfaces of unwrapped filter plugs. It has been found that uniting bands are likely to be shifted relative to and/or to become fully separated from the respective groups of rod-shaped articles during introduction into and/or during travel through the aforediscussed gap wherein the uniting bands are supposed to be converted into tubes which connect filter plugs to the respective plain cigarettes. This results in the production of substantial numbers of rejects which is especially undesirable in modern high-speed filter tipping machines.

OBJECTS AND SUMMARY OF THE INVENTION

An object of the invention is to provide a novel and improved method of treating filter plugs, especially unwrapped filter plugs (NWA filters), prior to their attachment to plain cigarettes, cigars or cigarillos.

Another object of the invention is to provide a method of the just outlined character which insures that the convoluting operation does not result in undesirable changes in orientation of uniting bands and/or in complete separation of such uniting bands from groups of coaxial rod-shaped articles which include at least one filter plug and at least one rod-shaped article constituting a wrapped tobacco filler.

A further object of the invention is to provide a method which can be practiced by resorting to slightly modified filter tipping or like machines and which insures predictable, reliable and simple attachment of uniting bands to the respective groups of rod-shaped articles while the machines are operated at normal speed or at a lower speed.

An additional object of the invention is to provide a novel and improved apparatus which can be utilized for the practice of the above outlined method.

Another object of the invention is to provide an apparatus which can utilize a large number of constituents of conventional filter tipping or like machines.

A further object of the invention is to provide a filter tipping machine which embodies the above outlined apparatus.

One feature of the invention resides in the provision of a method of treating or processing rod-shaped filter plugs, especially unwrapped filter plugs such as the so-called NWA plugs, prior to attachment of filter plugs to cigarettes or analogous rod-shaped tobacco-containing articles by means of adhesive-coated uniting bands. The method comprises the steps of applying heat and pressure to selected portions of peripheral surfaces of rod-shaped filter plugs to thereby smoothen such selected portions, and thereupon attaching portions of adhesive-coated uniting bands to the smoothed selected portions of peripheral surfaces of the filter plugs.

The method preferably further comprises the steps of placing the selected portions of peripheral surfaces of the filter plugs into contact with a countersurface, and moving the countersurface with respect to the selected portions of peripheral surfaces of filter plugs and/or vice versa so as to enhance the smoothness of such selected portions as a result of frictional engagement with the countersurface. The moving step preferably takes place simultaneously with the application of heat and pressure; in fact, the countersurface preferably constitutes the means for applying heat and pressure to selected portions of peripheral surfaces on a series of successive filter plugs which are caused to move sideways past a stationary smoothing device.

At least that part of each filter plug which is adjacent to the respective peripheral surface can consist of thermoplastic material, e.g., synthetic thermoplastic filamentary material which imparts to the peripheral surface of the untreated filter plug a certain amount of coarseness, such coarseness being eliminated (in the region of selected portions of peripheral surfaces) by the aforementioned countersurface as a result of simultaneous application of heat and pressure (and preferably further as a result of simultaneous frictional engagement with the countersurface).

Each filter plug can be placed in a position of axial alignment with at least one tobacco-containing rod-shaped article prior to the application of heat and pressure to selected portions of the peripheral surfaces of the filter plugs. The uniting bands are thereupon convoluted around the respective filter plugs and around the adjacent end portions of aligned rod-shaped articles, preferably in such a way that the portions of uniting bands which contact the selected portions of peripheral surfaces of the respective filter plugs are overlapped by second portions of the convoluted uniting bands and form therewith seams extending in parallelism with the axes of the filter plugs. Each selected portion is preferably a narrow strip extending in parallelism with the axis of the respective filter plug.

The novel features which are characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
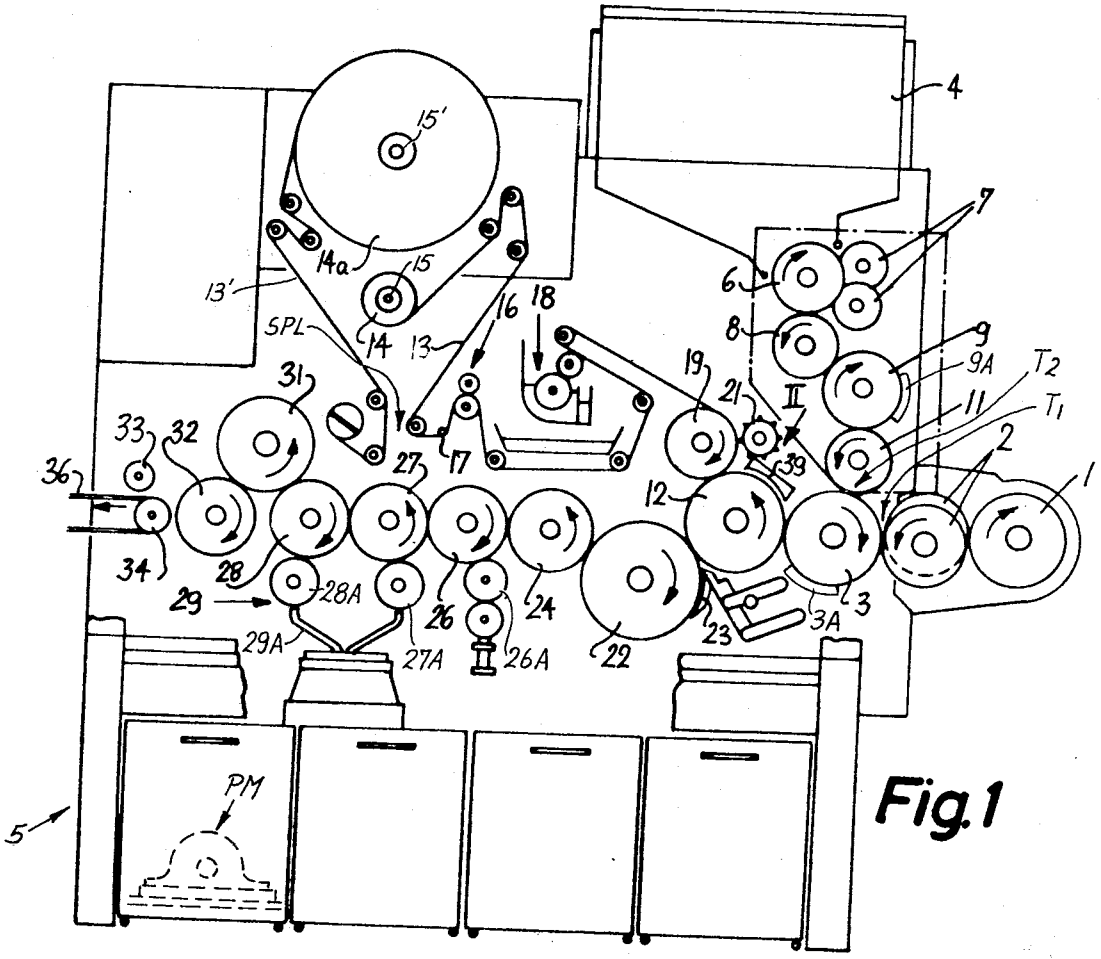
FIG. 1 is a schematic front elevational view of a filter tipping machine embodying an apparatus which is constructed and assembled in accordance with the invention.

FIG. 1 illustrates a filter tipping machine of the type known as MAX S (manufactured by the assignee of the present application). This machine is preferably directly coupled with a cigarette maker and its moving parts preferably receive motion from a prime mover PM which also drives the cigarette maker.

As shown in FIG. 1, a rotary drum-shaped row forming conveyor 1 of a cigarette maker (e.g., a machine known as GARANT 4 produced by the assignee of the present application) is mounted in the frame 5 of the filter tipping machine and delivers two axially staggered rows of plain cigarettes 20 of unit length (see FIG. 2) to two discrete rotary drum-shaped aligning conveyors 2. The conveyors 2 deliver plain cigarettes into successive flutes of a rotary drum-shaped assembly conveyor 3. The transfer station between the conveyors 2 and conveyor 3 is shown at T1.

The cigarettes of one row are disposed in the evenly numbered flutes and the cigarettes of the other row are located in the oddly numbered flutes of the conveyor 1. The conveyors 2 are driven at different speeds and/or transport the respective rows of plain cigarettes 20 through different distances so that each flute of the assembly conveyor 3 which arrives at the transfer station T1 receives two plain cigarettes, one from the first aligning conveyor 2 and the other from the second aligning conveyor 2. The axial distance between the two rows of plain cigarettes 20 in the flutes of the conveyor 1 is preferably such that the cigarettes of pairs of cigarettes in the flutes of the assembly conveyor 3 are separated from each other by gaps having a width (as considered at right angles to the plane of FIG. 1) at least equal to the length of a filter plug F (see FIG. 2) of double unit length.

The frame 5 further supports a magazine 4 for a supply of filter rod sections of six times unit length. Such sections are stacked in the magazine 4 in such a way that their axes are normal to the plane of FIG. 1. The magazine 4 has an outlet which receives a portion of a rotary drum-shaped severing conveyor 6 having peripheral flutes which withdraw filter rod sections from the magazine and transport them past two rapidly rotating disk-shaped knives 7 so that each filter rod section of six times unit length yields a set of three coaxial filter rod sections or filter plugs F of double unit length. The knives 7 are staggered with respect to each other, as considered in the axial and circumferential directions of the severing conveyor 6. The latter delivers sets of three coaxial filter plugs each to three discrete rollers of a rotary staggering conveyor 8 which serves to shift the filter plugs F of each set, as considered in the circumferential direction of the conveyor 8. The rollers of the staggering conveyor 8 have peripheral flutes for the filter plugs F and are driven at different speeds and/or transport the respective filter plugs through different distances so that each set of three coaxial plugs is converted into three plugs which are staggered with respect to each other. The thus shifted or staggered discrete plugs F are transferred into successive peripheral flutes of a rotary drum-shaped shuffling conveyor 9 which cooperates with two stationary cams 9A to convert the staggered plugs into a single row wherein each preceding plug is in exact alinement with the next-following plug.

The flutes of the shuffling conveyor 9 deliver successive filter plugs F of the single row into successive flutes of a rotary drum-shaped accelerating conveyor 11 which places successive filter plugs into successive flutes of the assembly conveyor 3. The transfer station where such insertion or placing occurs is shown at T2. Each filter plug F is inserted in such a way that it is disposed in the gap between two coaxial plain cigarettes 20 which are delivered at the transfer station T1.

The assembly conveyor 3 advances groups G (see FIG. 2) of three coaxial rod-shaped articles each (each such group includes two plain cigarettes 20 of unit length and a filter plug F of double unit length between the plain cigarettes) between two stationary condensing cams 3A which cause the plain cigarettes 20 to move axially into actual contact with the adjacent ends of the respective filter plugs F. The thus condensed groups G are delivered into successive flutes of a rotary drum-shaped moving conveyor or transfer conveyor 12.

The frame 5 further supports two spindles 15 and 15' for reels 14, **14*a* of wrapping material. The reel 14 is the running or expiring reel; the web 13 which is stored thereon is withdrawn by two advancing rolls 16 and successive increments thereof pass over the relatively sharp edge of a curling tool 17 of the type disclosed in commonly owned U.S. Pat. No. 3,962,957 granted June 15, 1976, to Alfred Hinzmann. The leader of the fresh web 13' which is stored on the reel 14a is located at a splicing station SPL and is preferably automatically attached to the adjacent portion of the running web 13 when the diameter of the expiring reel 14** is reduced to a pedetermined value. A device which can be used at the splicing station SPL to attach the leader of a fresh web to the running web is disclosed in commonly owned U.S. Pat. No. 3,730,811 granted May 1, 1973, to Hans-Joachim Wendt.

The leader of the running web 13 adheres to the foraminous peripheral surface of a rotary attaching conveyor here shown as a suction drum 19 which is adjacent to the transfer conveyor 12. During travel from the nip of the advancing rolls 16 to the peripheral surface of the suction wheel 19, successive increments of the web 13 advance along a paster 18 which coats one side of the web with a suitable adhesive. The leader of the web 13 is severed at regular intervals by the knives of a rotary knife carrier 21 which cooperates with the suction drum 19 to convert the web 13 into a single file of adhesive-coated uniting bands UB (see FIGS. 4 and 5). Successive uniting bands UB are attached to successive groups G of coaxial rod-shaped articles on the transfer conveyor 12, preferably in such a way that the adhesive-coated side of a uniting band UB adheres to the corresponding filter plug F (see FIG. 4) as well as to the adjacent (inner) end portions of the corresponding plain cigarettes 20 of unit length, and that the uniting band is substantially tangential to the respective group G (see FIG. 4). Such gruops are thereupon delivered to the periphery of a rotary drum-shaped draping conveyor 22 which cooperates with a stationary or mobile rolling device 23 to define a gap wherein the groups G are caused to rotate about their respective axes so as to convert the uniting bands UB into tubes (see FIG. 5) which sealingly connect the filter plugs F to the respective pairs of plain cigarettes 20. A rolling device which can be used in the filter tipping machine of FIG. 1 is disclosed in commonly owned U.S. Pat. No. 3,527,234 granted Sept. 8, 1970 to Alfred Hinzmann.

The conveyor 22 cooperates with the rolling device 23 to convert each group G and the respective uniting band UB into a filter cigarette of double unit length, and such filter cigarettes are delivered into the flutes of a rotary drum-shaped drying conveyor 24. The latter delivers successive filter cigarettes of double unit length into the flutes of the rotary drum-shaped severing conveyor 26 which cooperates with a rotary disk-shaped knife 26A to sever each filter cigarette midway between its ends (i.e., centrally across the convoluted uniting band UB) so as to form pairs of filter cigarettes of unit length. In addition, the severing conveyor 26 can serve for ejection of defective cigarettes, e.g., of cigarettes wherein the filter plugs are missing or of filter cigarettes wherein the tobacco containing ends are too soft or too dense.

The filter plugs of each freshly formed pair of filter cigarettes of unit length are adjacent to each other in the region immediately downstream of the severing conveyor 26. Therefore, the machine of FIG. 1 comprises a turn-around device 29 of the type disclosed in commonly owned U.S. Pat. No. 3,583,546 granted June 8, 1971, to Gerhard Koop. This device comprises a first rotary drum-shaped conveyor 27 whose flutes receive pairs of filter cigarettes of unit length from the severing conveyor 26. One filter cigarette of each pair is transferred onto a second rotary drum-shaped conveyor 27A of the turn-around device 29, and the other cigarettes of successive pairs are transferred into alternate flutes of a third rotary drum-shaped conveyor 28. The cigarettes which are located in the flutes of the conveyor 27A are withdrawn by successive orbiting arms 29A of the device 29 and are moved along arcs of 180 degrees prior to insertion into the flutes of a fourth rotary drum-shaped conveyor 28A. The latter delivers the inverted filter cigarettes of unit length into the empty flutes of the conveyor 28 so that the conveyor 28 advances a single row of filter cigarettes of unit length (the filter plugs of all filter cigarettes on the conveyor 28 face in the same direction) toward and into the flutes of a rotary drum-shaped testing conveyor 31. The conveyor 31 cooperates with a pneumatic or optical testing device which monitors the condition of wrappers of successive filter cigarettes of unit length and generates test signals to response in detection of wrappers having holes, frayed ends and/or open seams. Such test signals are used for ejection or segregation of defective filter cigarettes (more particularly, of cigarettes having defective wrappers) from the flutes of a rotary drum-shaped ejecting conveyor 32 which follows the testing conveyor 31.

The conveyor 32 can cooperate with a suitable device which tests the heads (tobacco containing ends) of successive filter cigarettes of unit length. This conveyor delivers satisfactory filter cigarettes of unit length onto the upper reach of an endless belt conveyor 36 which is trained over pulleys 34 (only one shown). The illustrated pulley 34 cooperates with a rotary braking drum 33. The belt conveyor 36 delivers a row of filter cigarettes (which move sideways) to a packing machine, into a mass-flow linking unit (e.g., a unit of the type known as Resy and manufactured by the assignee of the present application) or into storage.

Figure 2:
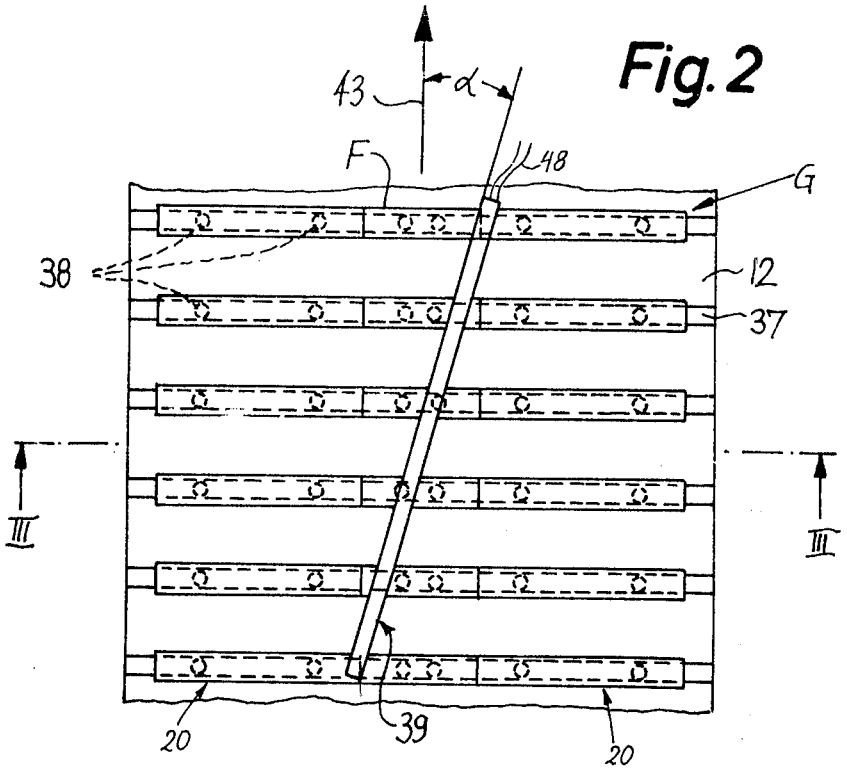
FIG. 2 is an enlarged view as seen in the direction of arrow II in FIG. 1.
Figure 3:
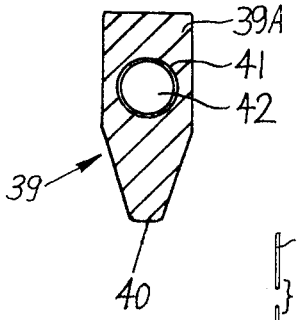
FIG. 3 is a sectional view of the smoothing device as seen in the direction of arrows from the line III–III of FIG. 2.

FIG. 2 is a developed view of a portion of the transfer conveyor 12 and further shows a smoothing device 39 which reduces the coarseness of selected portions 44 of the peripheral surfaces of filter plugs F to thus insure satisfactory adherence of uniting bands UB thereto. The smoothing device 39 comprises an elongated strip-shaped member or bar 39A which may consist of metallic or other suitable heat-conducting material and is secured to the frame 5 in a manner not specifically shown in the drawing. The direction in which the peripheral surface of the conveyor 12 rotates to move the groups G sideways is indicated by the arrow 43. The bar 39A is inclined with respect to such direction; as shown in FIG. 2 the angle alpha which the longitudinal direction of the bar 39A makes with a plane normal to the axis of the conveyor 12 is a relatively small acute angle.

The peripheral surface of the conveyor 12 is formed with axially parallel flutes 37 making with the bar 39A an angle of 90 degrees minus alpha. During travel past the bar 39A, each such flute 37 carries a group G of three coaxial rod-shaped articles, namely, two plain cigarettes 20 of unit length and a filter plug F of double unit length therebetween. The reference characters 38 denote suction ports which are machined into the conveyor 12 to connect the flutes 37 with a suitable suction generating device (not shown) in order to insure that the groups G adhere to the conveyor 12 during travel along a path extending from the assembly conveyor 3, past the suction drum 19 and on to the draping conveyor 22.

The bar 39A has a longitudinally extending bore or hole 41 for a conventional heating cartridge 42. FIG. 2 shows portions of conductors 48 which connect the cartridge 42 to a source of electrical energy (not shown). The relatively narrow but elongated inner surface or countersurface 40 of the bar 39A contacts the aforementioned selected portions 44 of foraminous peripheral surfaces of filter plugs F during travel of successive groups G past the smoothing device 39. The distance between the countersurface 40 and the deepmost portion of the nearest flute 37 on the conveyor 12 is somewhat less than the diameter of a filter plug F. This insures that the countersurface 40 frictionally engages the adjacent filter plugs F during travel of corresponding groups G along a certain portion of the arcuate path which is defined by the conveyor 12. The countersurface 40 is a concave surface (see FIG. 1) and its distance from the periphery of the conveyor 12 is constant.

Figure 4:
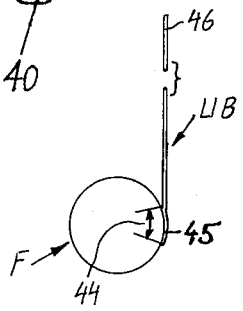
FIG. 4 is an enlarged end elevational view of a filter plug with a uniting band partially attached thereto.
Figure 5:
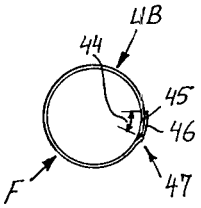
FIG. 5 is a similar end elevational view of the filter plug, the uniting band being convoluted therearound.

It will be noted that the width of the heated countersurface 40 is only a small fraction of the length of a filter plug F, as considered in the axial direction of the groups G. This, in combination with the magnitude of the selected angle alpha, enables the countersurface 40 to contact, seriatim, successive increments of the selected portion 44 of the peripheral surface of a filter plug F, as considered in the axial direction of such filter plug. The countersurface 40 thereby heats and applies pressure against the relatively narrow strip-shaped selected portion 44 of the peripheral surface of each filter plug F, namely, that portion which is overlapped by the seam 47 of the fully convoluted uniting band UB. FIG. 4 shows a uniting band UB upon attachment of one of its marginal portions 45, 46 to the smoothed selected portion 44 of the peripheral surface of a filter plug F, and FIG. 5 shows the seam 47 which is formed by the marginal portions 45, 46 of the uniting band UB upon conversion into a tube. The selected portion 44 is sufficiently smooth to insure predictable adherence of the marginal portion 45.

The smoothing device 39 treats those (selected) portions 44 of successive filter plugs F which are first to contact the (marginal portions 45 of) corresponding uniting bands UB during transport past the suction drum 19. Frictional engagement with the heated countersurface 40 (which exerts pressure against the filter plugs F) suffices to achieve a smoothing action which guarantees predictable adherence of marginal portions 45.

It is likely, or at least possible, that the smoothing action of the device 39 alters (reduces) the permeability of selected portions 44. However, this is of no consequence because such selected portions are adjacent to the seams 47 (FIG. 5) of the respective filter cigarettes. As a rule, the permeability of seams is zero or, at the very least, much less than the permeability of non-overlapped portions of the tubular (convoluted) uniting band. In other words, the countersurface 40 reduces the permeability of that portion (44) of the peripheral surface of a filter plug F which is not relied upon for admission of atmospheric air into the column of tobacco smoke.

Mounting of the smoothing device 39 immediately upstream of or at least close to the station where the suction drum 19 attaches uniting bands UB to successive groups G is preferred at this time because this insures that the surface portions 44 remain smooth during attachment of marginal portions 45. Furthermore, it is less likely that the orientation of freshly smoothed portions 44 with respect to the marginal portions 45 of uniting bands UB will change during transport of groups G along the short path portion from the smoothing device 39 to the drum 19, especially if the groups G are transported by one and the same endless conveyor (12) during travel past the device 39 as well as during travel past the drum 19.

Frictional engagement between the stationary countersurface 40 and successive increments of surface portions 44 of filter plugs F moving past the smoothing device 39 should not be very pronounced in order to avoid rolling of filter plugs about their respective axes. It should be borne in mind that the peripheral surfaces of filter plugs F are foraminous, i.e., air which flows into the suction ports 38 of the conveyor 12 cannot attract the plugs F with a great force. Therefore, the distance between the deepmost portions of flutes 37 which move past the smoothing device 39 and the countersurface 40 should be such that frictional engagement between the countersurface 40 and successive surface portions 44 will not overcome the attraction between the conveyor 12 and filter plugs F. The utilization of a relatively narrow countersurface 40 contributes to a reduction of the likelihood of rolling of filter plugs F during transport past the device 39. The interval of contact between the countersurface 40 and successive increments of surface portions 44 is short due to the aforediscussed inclination of the device 39 with respect to the direction which is indicated by the arrow 43. This reduces the likelihood of overheating of the countersurface and of damage to filter plugs.

The cams 3A can be placed adjacent to the transfer conveyor 12 upstream of the smoothing device 39.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. A method of processing rod-shaped filter plugs prior to their attachment to cigarettes or analogous rod-shaped tobacco-containing articles by means of adhesive-coated uniting bands, comprising the steps of applying heat and pressure to selected narrow strip-shaped portions of peripheral surfaces of rod-shaped filter plugs to smoothen such selected portions, said selected portions extending in parallelism with the axes of the respective filter plugs; and thereupon attaching portions of adhesive-coated uniting bands to said selected portions.

2. The method of claim 1, wherein said filter plugs are unwrapped filter plugs.

3. The method of claim 1, further comprising the step of placing the selected portions of peripheral surfaces of filter plugs into contact with a countersurface, and moving the countersurface with respect to said selected portions and/or vice versa so as to enhance the smoothness of such selected portions as a result of fractional engagement with said countersurface.

4. The method of claim 3, wherein said moving step takes place simultaneously with the application of heat and pressure.

5. The method of claim 1, wherein at least that part of each filter plug which is adjacent to the respective peripheral surface consists of thermoplastic material.

6. The method of claim 1, further comprising the step of placing each filter plug into a position of axial alignment with at least one tobacco-containing rod-shaped article prior to the application of heat and pressure to the selected portion of the peripheral surface of such filter plug.

7. The method of claim 6, further comprising the step of convoluting the attached uniting bands around the respective filter plugs and around the adjacent portions of aligned rod-shaped articles.

8. Apparatus for processing rod-shaped filter plugs prior to their attachment to cigarettes or analogous rod-shaped tobacco-containing articles by means of adhesive-coated uniting bands, comprising conveyor means for transporting a series of filter plugs along a predetermined path; means for smoothing selected narrow strip-shaped portions of peripheral surfaces of filter plugs in a first portion of said path to smoothen such selected portions, said selected portions extending in parallelism with the axes of the respective filter plugs; and means for attaching portions of adhesive-coated uniting bands to said selected portions in a second portion of said path downstream of said first portion.

9. Apparatus as defined in claim 8, wherein said smoothing means comprises a heated countersurface which is adjacent to said first portion of said path.

10. Apparatus as defined in claim 9, wherein the distance between said conveyor means and said smoothing means is such that said countersurface contacts said selected portions of peripheral surfaces of filter plugs in said first portion of said path.

11. The apparatus of claim 8, wherein said conveyor means includes an endless conveyor which defines said first and second portions of said path.

12. The apparatus of claim 8, further comprising means for convoluting the uniting bands around the respective filter plugs in a third portion of said path downstream of said second portion.

13. The apparatus of claim 8, further comprising means for placing said filter plugs into axial alignment with cigarettes or analogous rod-shaped tobacco-containing articles in a fourth portion of said path upstream of said first portion.

14. The apparatus of claim 8, wherein said first portion of said path is arcuate and said countersurface is concave.

15. A method of processing rod-shaped unwrapped filter plugs prior to their attachment to cigarettes or analogous rod-shaped tobacco-containing articles by means of adhesive-coated uniting bands, comprising the steps of applying heat and pressure to selected portions of peripheral surfaces of rod-shaped filter plugs to smoothen such selected portions; thereupon attaching portions of adhesive-coated uniting bands to said selected portions; and moving said filter plugs at right angles to their axes in the course of said applying and attaching steps.

16. The method of claim 15, wherein each of said selected portions is a narrow strip extending in parallelism with the axis of the respective filter plug.

17. Apparatus for processing rod-shaped filter plugs having a predetermined diameter prior to their attachment to cigarettes or analogous rod-shaped tobacco-containing articles by means of adhesive-coated uniting bands, comprising conveyor means for transporting a series of filter plugs along a predetermined path, said conveyor means having flutes for filter plugs and said flutes having deepmost portions; means for smoothing selected portions of peripheral surfaces of filter plugs in a first portion of said path to smoothen such selected portions, said smoothing means comprising a heated countersurface which is adjacent to said first portion of said path, the distance between the deepmost portions of said flutes in said first portion of said path and said countersurface being slightly less than said predetermined diameter so that said countersurface contacts said selected portions of peripheral surfaces of filter plugs in said first portion of said path; and means for attaching uniting bands to said selected portions in a second portion of said path downstream of said first portion.

18. Apparatus for processing rod-shaped filter plugs having a predetermined length, as considered in the axial direction thereof, prior to attachment of filter plugs to cigarettes or analogous rod-shaped tobacco-containing articles by means of adhesive-coated uniting bands, comprising conveyor means including means for transporting a series of filter plugs along a predetermined path at right angles to the axes of the filter plugs; means for smoothing selected portions of peripheral surfaces of filter plugs in a first portion of said path to smoothen such selected portions, said smoothing means including an elongated heated countersurface which is adjacent to said first portion of said path and has a width which is a fraction of said predetermined length, said countersurface making an oblique angle with the axes of filter plugs in said first portion of said path; and means for attaching portions of adhesive-coated uniting bands to said selected portions in a second portion of said path downstream of said first portion.

19. The apparatus of claim 18, wherein said countersurface contacts said selected portions of peripheral surfaces of filter plugs in said first portion of said path.

* * * * *